United States Patent [19]

Burton

[11] 4,306,385

[45] Dec. 22, 1981

[54] INVOLUTE KNIFE SHARPENER

[75] Inventor: Walter T. Burton, Enfield, England

[73] Assignee: Berkel & Parnall Limited, Enfield, England

[21] Appl. No.: 100,519

[22] Filed: Dec. 5, 1979

Related U.S. Application Data

[63] Continuation-in-part of Ser. No. 3,086, Jan. 12, 1979, abandoned.

[30] Foreign Application Priority Data

| | | | |
|---|---|---|---|
| Jan. 13, 1978 | [GB] | United Kingdom | 01537/78 |
| Oct. 7, 1978 | [GB] | United Kingdom | 39710/78 |
| Apr. 12, 1979 | [GB] | United Kingdom | 12944/79 |
| Oct. 30, 1979 | [GB] | United Kingdom | 37588/79 |

[51] Int. Cl.[3] ..... B24B 5/02

[52] U.S. Cl. ..... 51/249

[58] Field of Search ..... 51/246, 247, 248, 249; 83/174, 174.1; 76/85

[56] References Cited

U.S. PATENT DOCUMENTS

| | | | |
|---|---|---|---|
| 680,033 | 8/1901 | Fellows . | |
| 680,045 | 8/1901 | Hopkins . | |
| 680,137 | 8/1901 | Fellows . | |
| 680,148 | 8/1901 | Hopkins . | |
| 753,630 | 3/1904 | Rich | 51/247 |
| 810,767 | 1/1906 | Johnson . | |
| 1,731,533 | 10/1929 | Huff | 51/250 |
| 2,738,628 | 3/1956 | Lust | 51/247 |
| 2,978,848 | 4/1961 | Raine | 51/247 |
| 3,820,289 | 6/1974 | Good | 51/248 |
| 4,019,286 | 4/1977 | Spooner | 51/248 |

*Primary Examiner*—Roscoe V. Parker
*Attorney, Agent, or Firm*—Lloyd L. Zickert

[57] ABSTRACT

A sharpener for the knife blade of a slicing machine wherein the cutting edge of the knife blade is of involute shape. The mechanism comprises a pinion which is coaxially securable to the knife blade drive shaft, an elongate member in driving connection with the pinion and a sharpening mechanism mounted on the elongate member. The elongate member is moved pivotally and longitudinally with respect to the pinion whereby the sharpening mechanism follows the involute contour of the knife blade cutting edge during the sharpening procedure. To avoid unwanted movements of the sharpening mechanism the elongate member and pinion are mounted on a support means which includes an arm extending in the same longitudinal direction as the elongate member, and a slide block is slidably mounted on the arm and carries therewith the elongate member and the sharpening mechanism. Beyond the slide block the arm carries a handle for actuating the sharpener and a mounting for a guide wheel so that when the sharpener is fitted to the knife blade drive shaft for sharpening purposes the guide wheel can follow a circular path radially beyond the cutting edge of the knife. In one embodiment this circular path is formed on the casing surrounding the knife blade.

32 Claims, 22 Drawing Figures

INVOLUTE KNIFE SHARPENER

This application is a continuation-in-part application of my copending application Ser. No. 003,086 filed Jan. 12, 1979, now abandoned.

This invention relates in general to apparatus for sharpening the knife blade of a slicing machine for comestible products, wherein the knife blade is of involute or noncircular shape, and more particularly, to an apparatus that is mountable on the knife blade drive shaft during the sharpening process.

In a slicing machine of this kind the knife blade perimeter is shaped such that points on the perimeter lie at varying distances from the axis of the knife blade drive shaft lying between maximum and minimum radii according to a mathematical function of the angular position of the point with respect to either the maximum or minimum radii.

According to the present invention there is provided an apparatus for sharpening a knife blade of a slicing machine comprising a first member securable coaxially to the knife blade drive shaft in a predetermined angular orientation, said first member having a peripheral drive surface, an elongate member in driving connection with the drive surface of the first member, a knife blade sharpening mechanism mounted at one end of said elongate member, means for effecting relative pivotal and longitudinal movement of the elongate member with respect to the drive surface of the first member, wherein the first member and the elongate member are dimensioned are arranged so that, in use, said relative pivotal and longitudinal movement causes said sharpening mechanism to follow a predetermined non-circular path.

Preferably, said driving connection comprises matched (gear) teeth formed respectively on the first member and the elongate member. Alternatively, said driving connection may comprise a friction engagement between said first member and said elongate member.

Preferably, said means for effecting relative pivotal and longitudinal movement comprises a handle secured to a housing surrounding the driving connection whereby, in use, the elongate member is pivotally movable manually and longitudinally movable by said driving connection while the first member is held stationary in relation to the knife shaft. Alternatively, the means for effecting relative pivotal and longitudinal movement may comprise slideway-defining elements connected to the elongate member and to a fixed support, and a handle connected to the first member whereby the first member is rotated manually and the elongate member is constrained against rotational movement but is free to move longitudinally.

Preferably, the sharpening mechanism comprises first and second means disposed for engagement with opposite sides of the knife blade. Conveniently, said first means is a grinding wheel connected to a drive means, such as an electric or a pneumatic motor, and the second means is a non-driven tip made of highly hardened material. Alternatively said second means is a grinding wheel which is freely rotatable on a spindle. The said second means may be mounted on a carrier which is movable between in-use and out-of-use positions and which, in use, scrapes or otherwise removes from the rear of the blade burrs which are produced during the sharpening procedure.

In the case when said second means is a grinding wheel which is freely rotatable on a spindle, the grinding wheel may also be spring biased axially of its mounting on said carrier. The driven grinding wheel may be adjustably secured on a carrier whereby the grinding angle may be adjusted.

The carrier for the driven grinding wheel acts as a support for the carrier of the said second means. Further, the carrier for the driven grinding wheel and the elongate member may include an interconnection to constrain the extent of pivotal movement of said carrier with respect to the elongate member. Said interconnection may include a resilient element, such as a spring, whereby the said carrier is urged pivotally in a predetermined direction.

The grinding wheel follows a path parallel to the contour of the cutting edge of the said knife, and by supporting the elongated member by means of a roller running on a machined bevel of said knife or by supporting the handle secured to said housing by means of a roller running on a machined surface of the machine casing carrying the knife shaft to which said knife is connected, the actual grinding section of this grinding wheel will follow the plane of the said cutting edge.

Additionally, the first member and said knife blade incorporate interengageable elements whereby the predetermined orientation of the first member is assured when the elements are interengaged. The interengageable elements may be in the form of a spigot or pin and a socket.

Where there is a tendency for the sharpening mechanism to move towards and away from the knife blade cutting edge during use resulting in an uneven cutting action, we have devised a modification of the sharpening apparatus wherein this disadvantage is obviated or mitigated.

According to the modification, there is provided an apparatus for in situ or in place sharpening of a slicing machine knife blade, which comprises a first member securable coaxially to the knife blade drive shaft in a predetermined angular orientation, said first member having a peripheral drive surface, an elongate member in driving connection with the drive surface of the first member, a knife blade sharpening mechanism mounted at one end of said elongate member, means for effecting relative pivotal and longitudinal movement of the elongate member with respect to the drive surface of the first member, wherein the first member and the elongate member are dimensioned and arranged so that, in use, said relative pivotal and longitudinal movement causes said sharpening mechanism to follow a predetermined non-circular path. The improvement comprises a support means confining the first member and the elongate member to maintain said driving connection, a rigid arm extending laterally from said support means in a direction parallel to the longitudinal axis of the elongate member and a guide member secured to the elongate member adjacent the sharpening mechanism and slidably mounted on said rigid arm, and a guide roller mounted on the rigid arm at a fixed location beyond the sharpening mechanism, whereby the guide roller may run along a fixed circular guide path radially beyond the cutting edge of the knife blade.

A first embodiment of the present invention is illustrated in FIGS. 1 to 4 in which.

Figure 5:
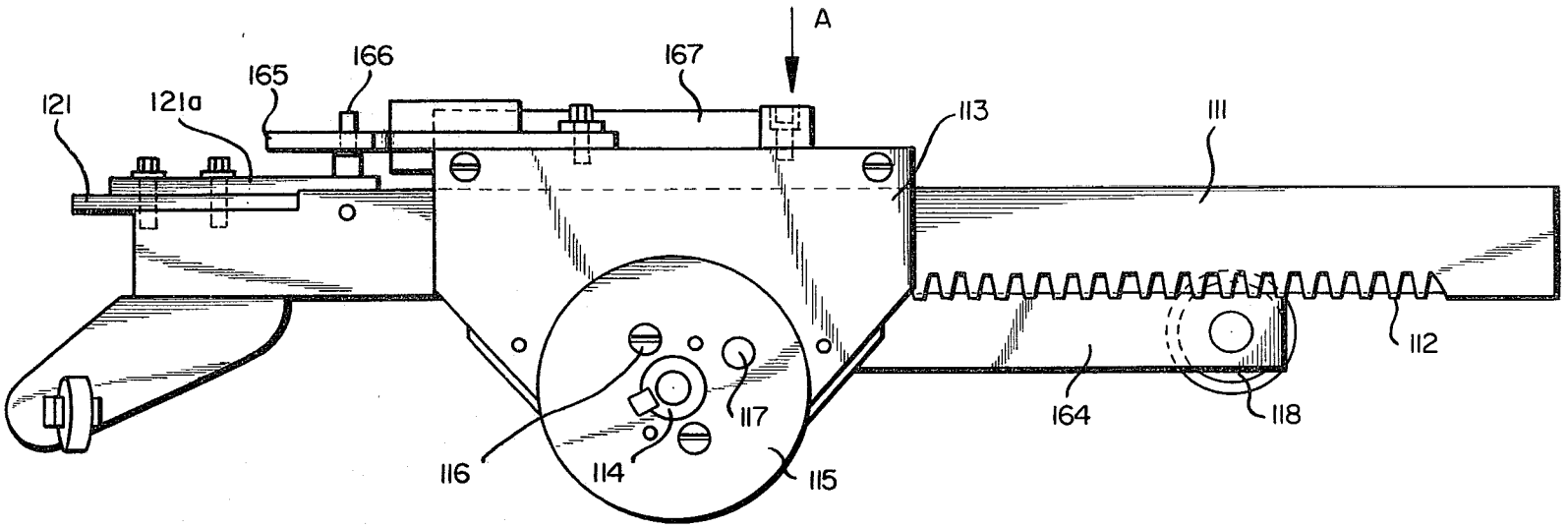
Figure 6:
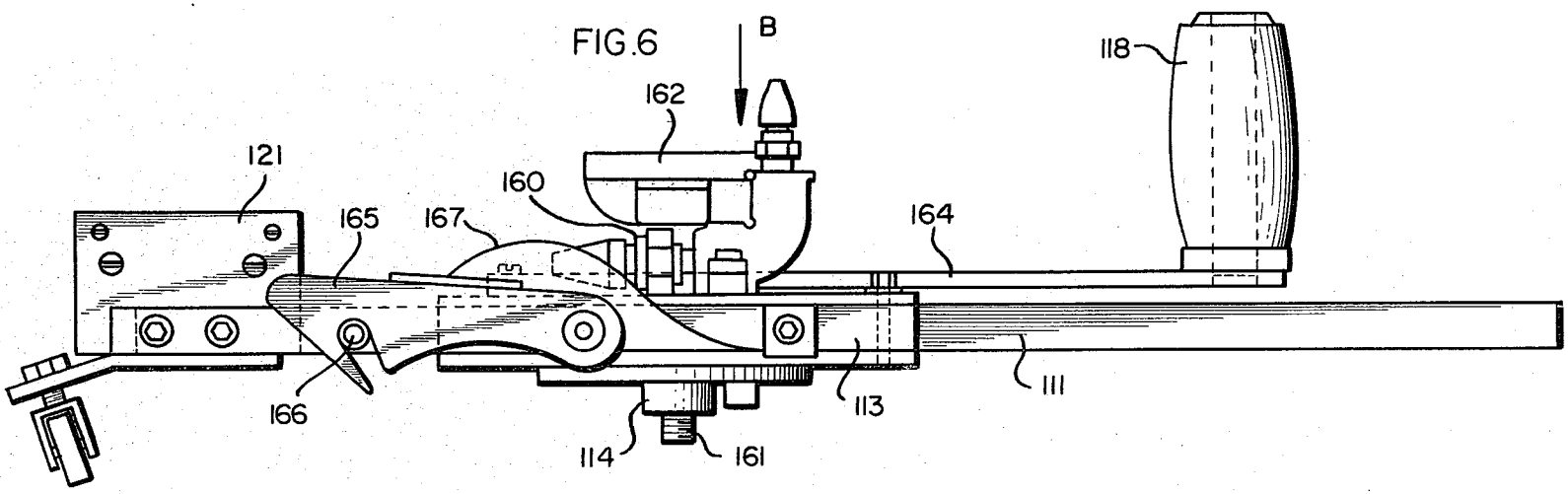
Figure 7:
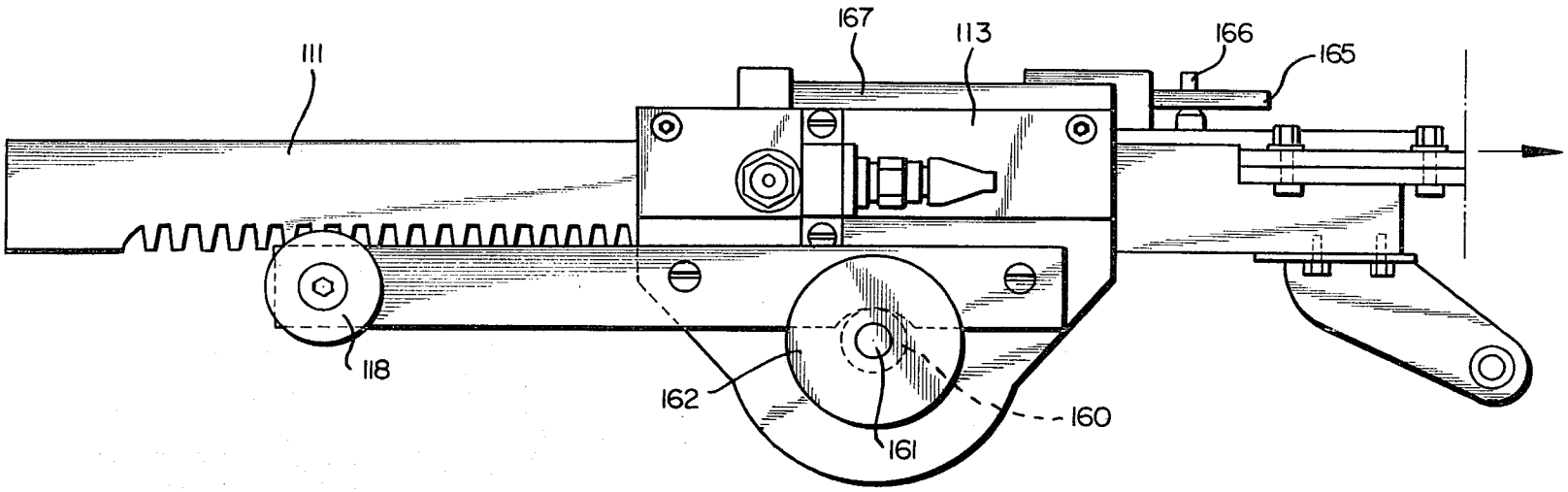
Figure 10:
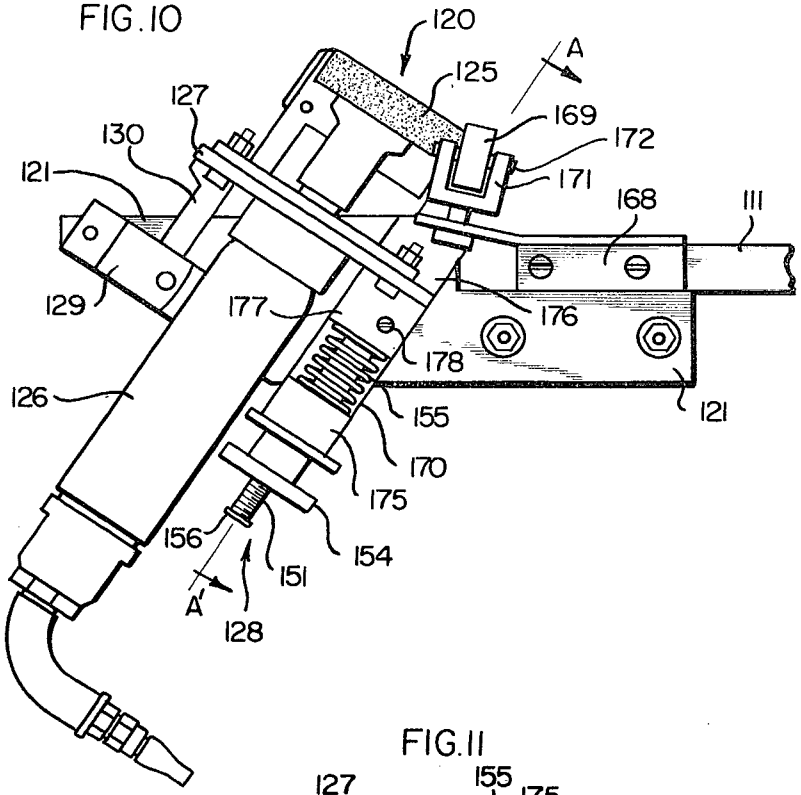
Figure 11:
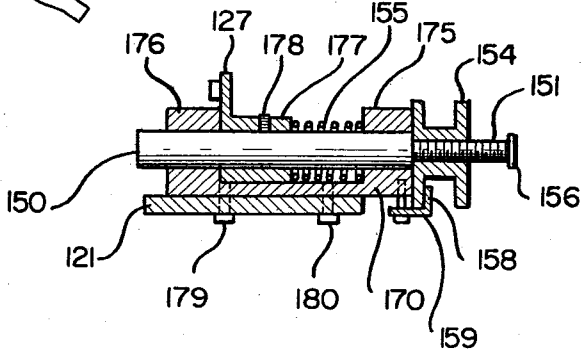
Figure 8:
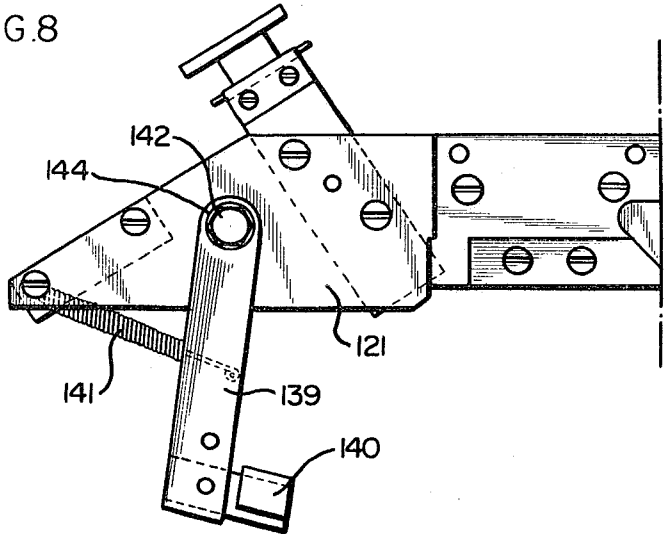
Figure 9:
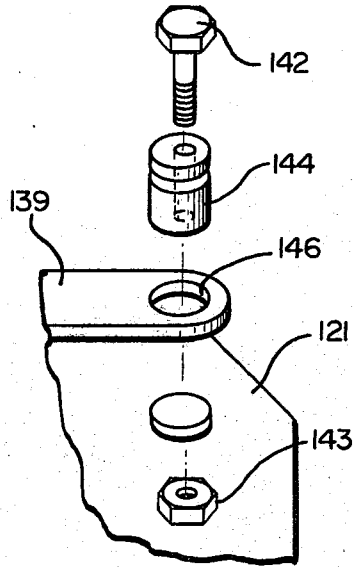
Figure 12:
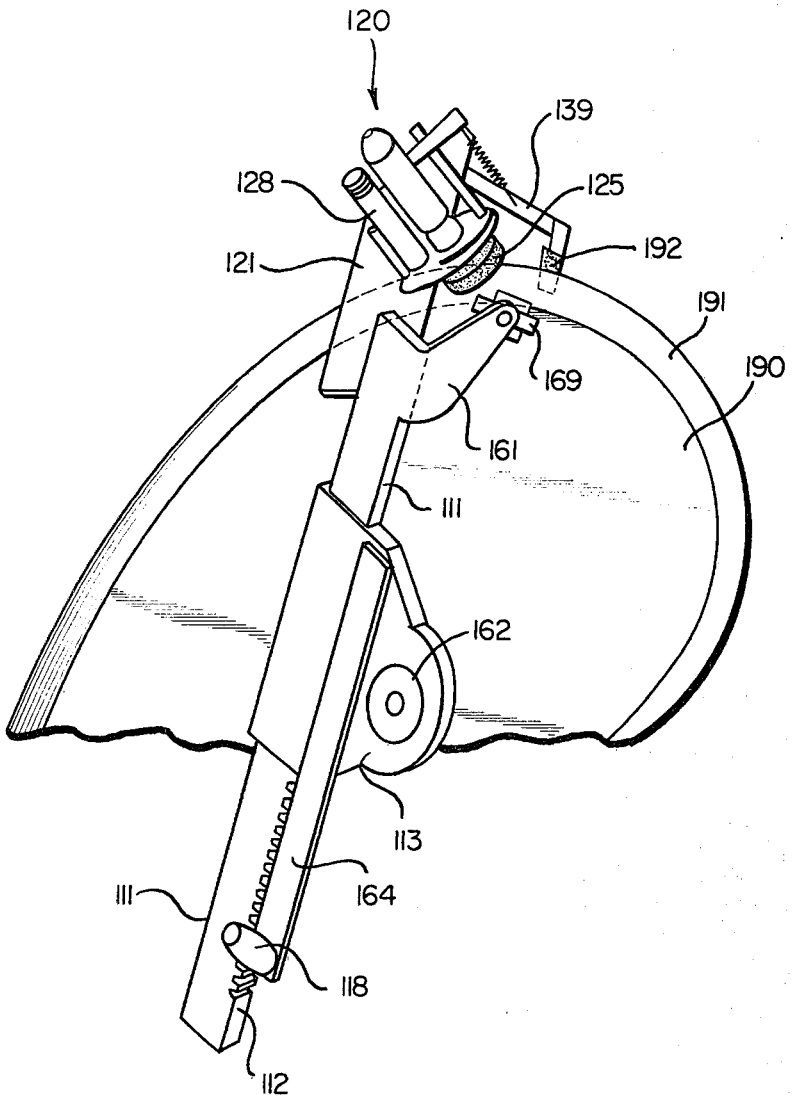

A second embodiment of the present invention is illustrated in FIGS. 5 to 12 in which:

FIG. 5 is a view of part of the knife sharpener apparatus taken from the side which is fitted to the knife blade;

FIG. 6 shows a view of the sharpener taken in the direction of the arrow A in FIG. 5;

FIG. 7 shows a view of the sharpener taken in the direction of the arrow B in FIG. 6;

FIG. 8 shows part of the sharpening mechanism;

FIG. 9 shows an exploded view of a detail in FIG. 8;

FIG. 10 shows another view of the sharpening mechanism;

FIG. 11 is a cross-sectional view of a detail, taken along line A—A' in FIG. 10; and FIG. 12 is a view of the sharpener in a sharpening position.

Figures 13, 14:
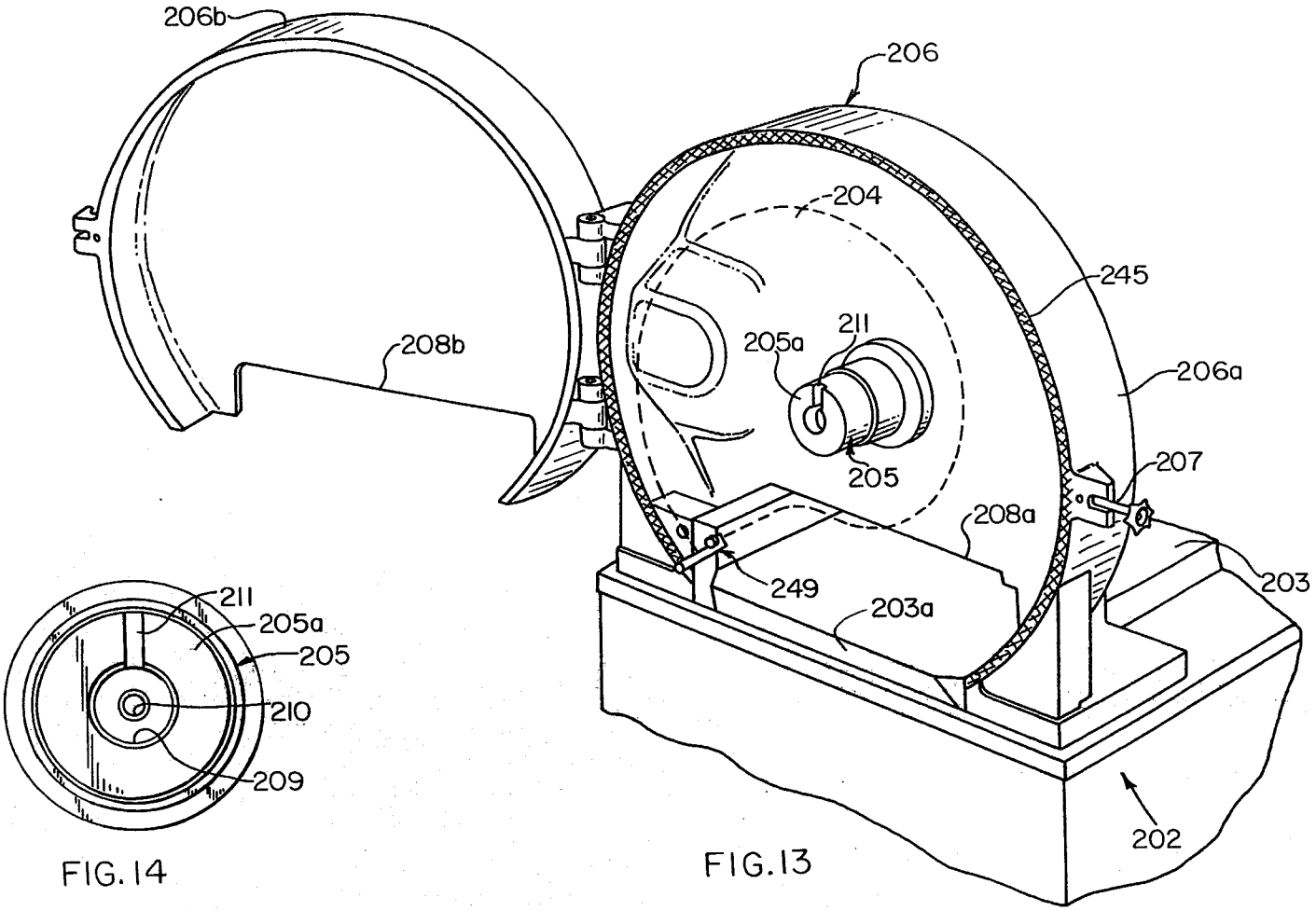
Figures 15, 16, 17, 18:
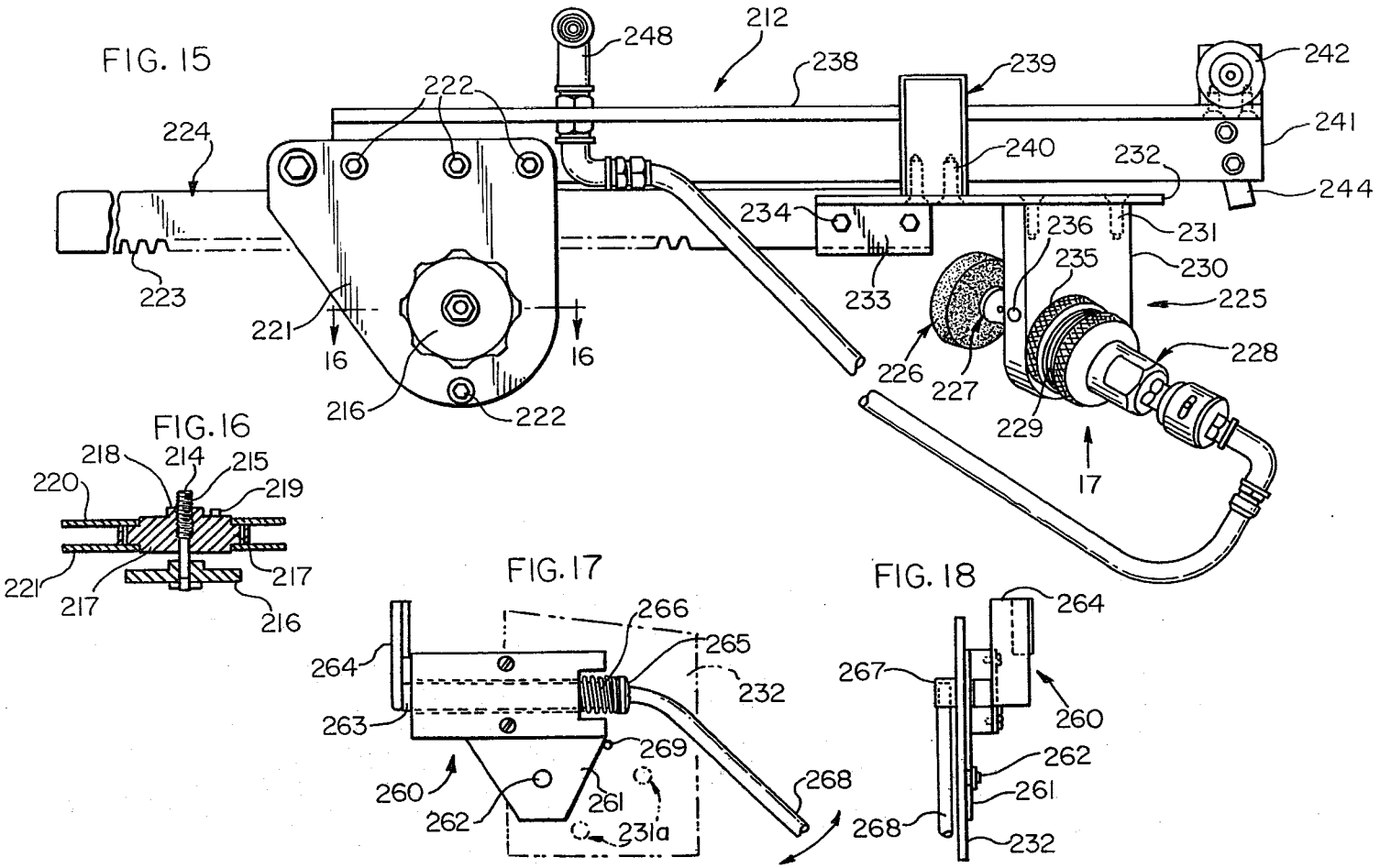
Figure 19:
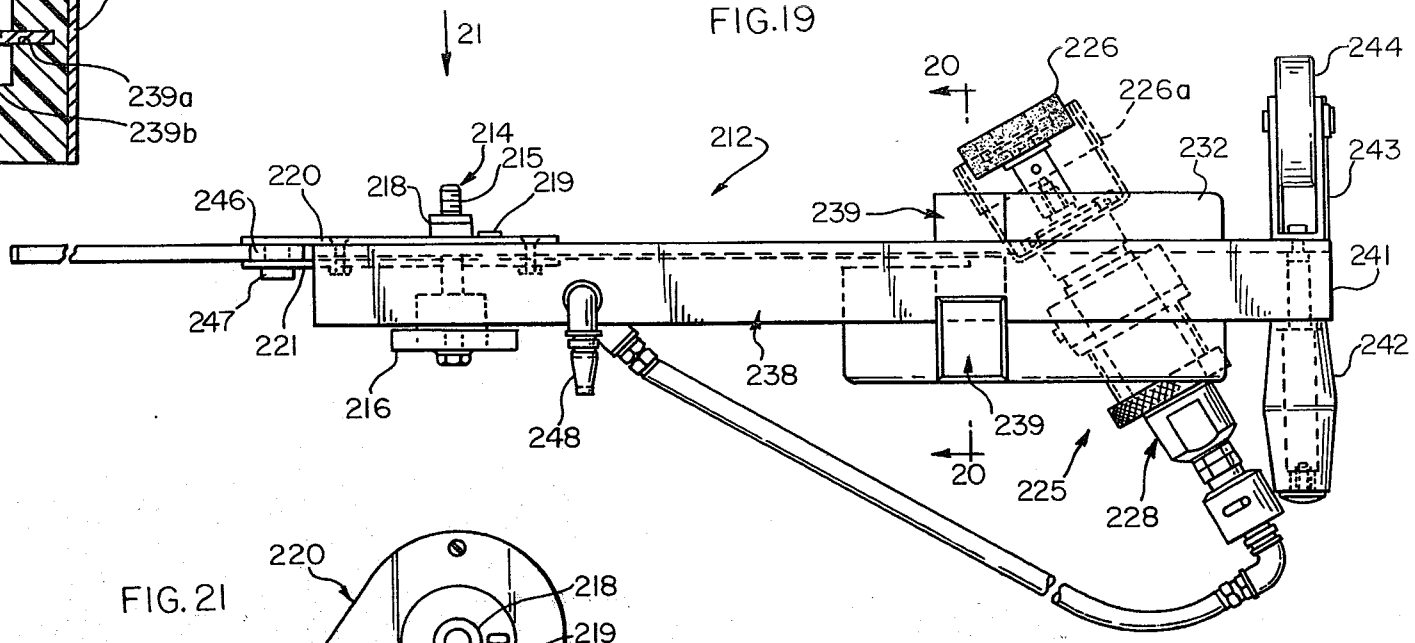
Figure 21:
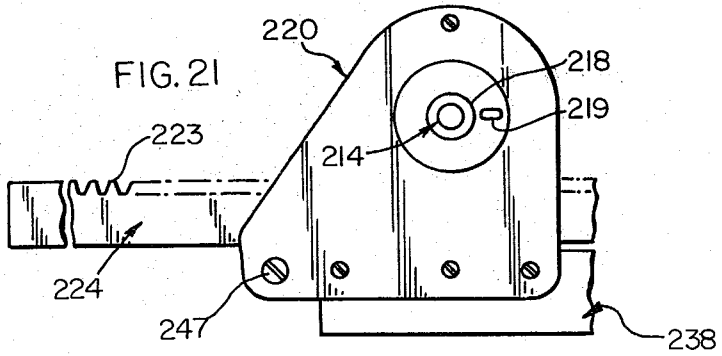
Figure 20:
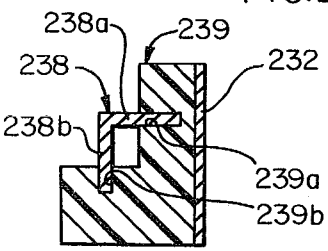
Figure 22:
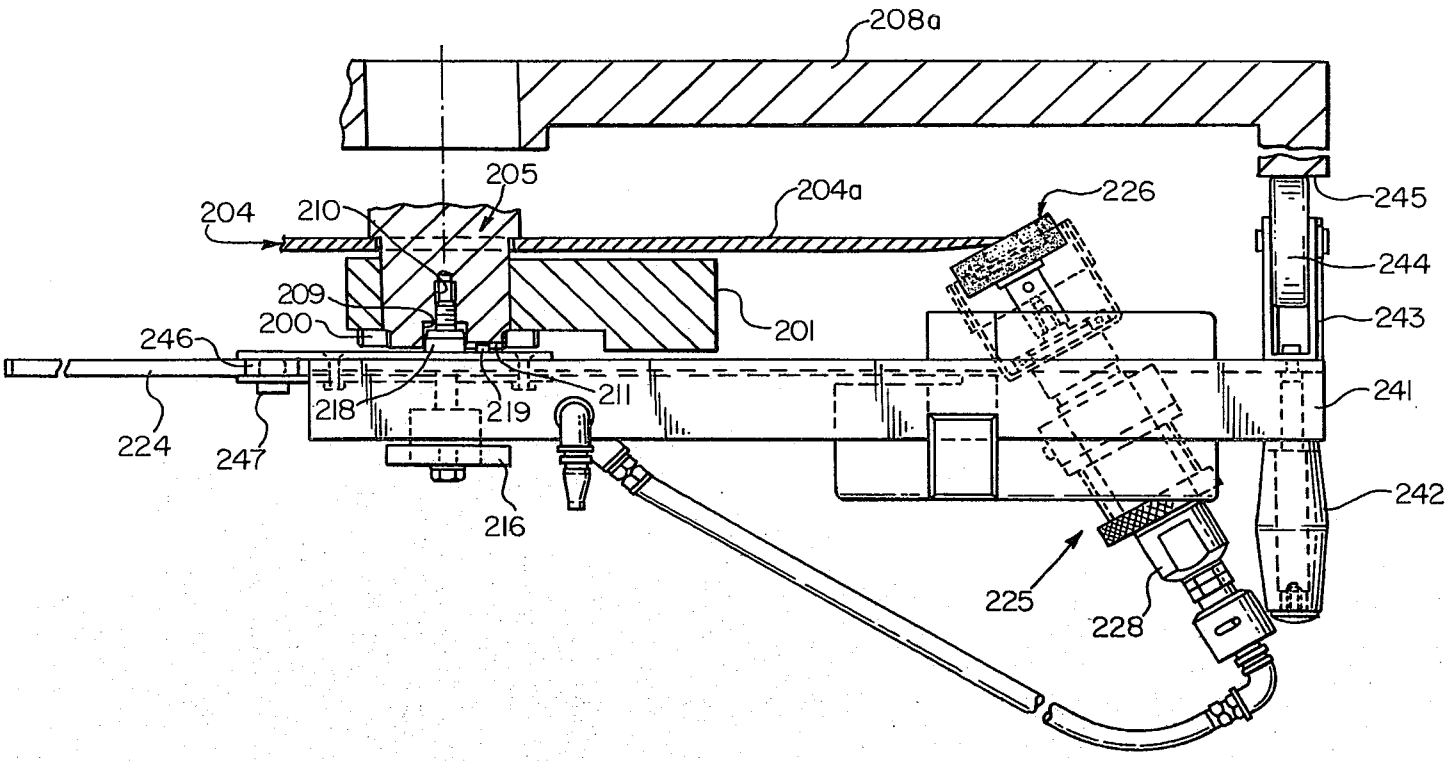

A third embodiment of the present invention is illustrated in FIGS. 13 to 22 in which:

FIG. 13 illustrates part of a slicing machine with an involute knife blade;

FIG. 14 is an enlarged end view of the knife blade drive shaft shown in FIG. 13;

FIG. 15 is an elevational view of sharpening apparatus according to the present invention;

FIG. 16 is a sectional view of a detail taken substantially along line 16—16 of FIG. 15;

FIG. 17 is an underneath plan view taken in the direction of the arrow 17 in FIG. 15 showing a device for deburring the knife blade which can be fitted to the apparatus according to the present invention;

FIG. 18 is a side view of FIG. 17;

FIG. 19 is a top plan view of FIG. 15;

FIG. 20 is a sectional view of a detail taken substantially along line 20—20 of FIG. 19;

FIG. 21 is an elevational view of a detail taken in the direction of the arrow 21 in FIG. 19; and FIG. 22 is a view similar to FIG. 19 but showing the sharpening apparatus in operative position on a slicing machine.

Figure 1:
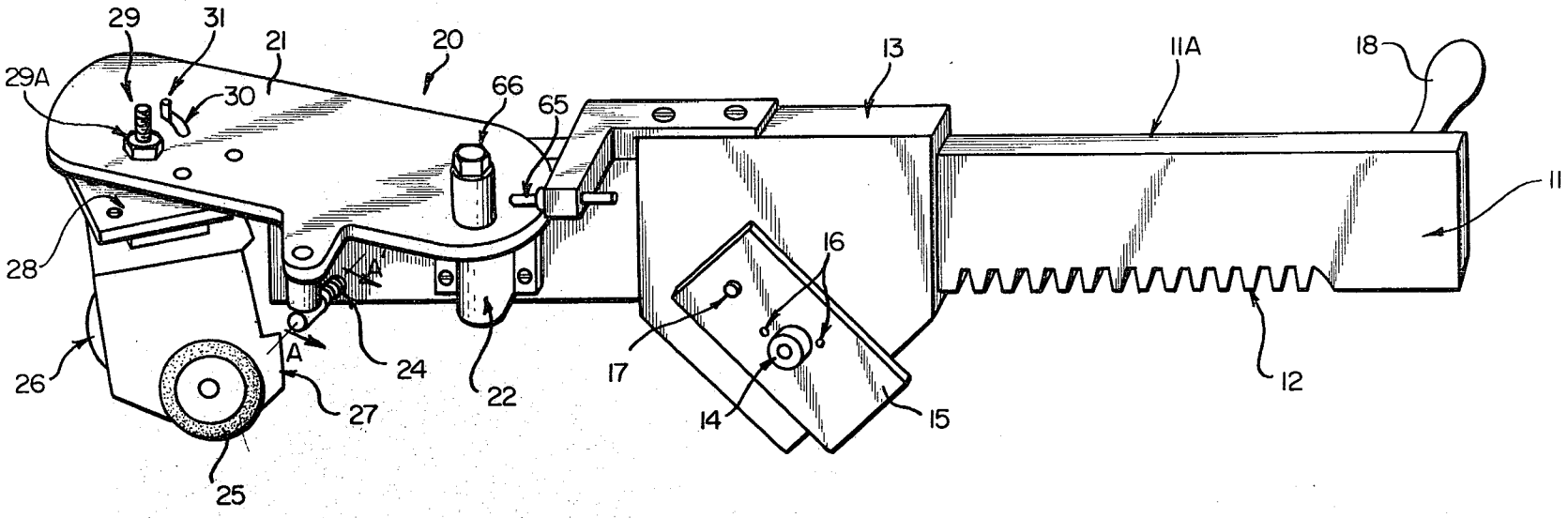
FIG. 1 is a view of part of the apparatus according to the present invention.
Figure 4:
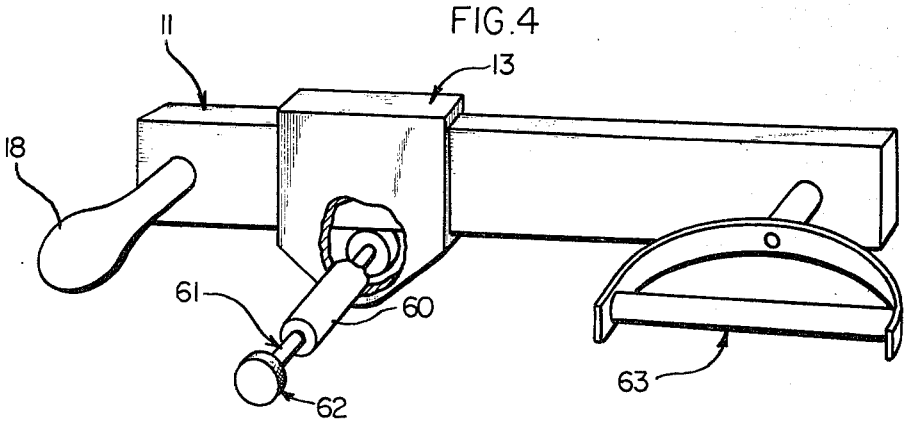
FIG. 4 shows a view of part of the apparatus of FIG. 1 and illustrates a friction grip drive.

In the first embodiment, the components of the apparatus are principally made of polished stainless steel, in the interests of hygiene, and they comprise, as shown in FIG. 1, an elongate member 11 incorporating a toothed rack 12; a housing 13 through which the member 11 passes and which contains a cog wheel or gear wheel (not shown) in mesh with the rack 12. The cog wheel incorporates a boss 14 which projects through the housing 13 and to which is secured a plate 15, by means of asymmetrically disposed screws 16. Alternatively, a friction grip drive may be employed as illustrated in FIG. 4. The plate 15 carries a spigot or pin 17 which is in a predetermined angular orientation with respect to the cog wheel and rack 12. At one end the member 11 carries a handle 18 and at the other end the member 11 carries sharpening mechanism 20, parts of which are omitted from FIG. 1 in the interests of clarity.

The mechanism 20 comprises a carrier arm 21 which is pivotally mounted at 22 to the member 11. By virtue of the pivot mounting 22 being disposed on the side surface of the member 11 a substantial part of the arm 21 is supported by the upper surface 11A of the member 11. In addition to the pivotal mounting 22, the arm 21 and the member 11 are interconnected at 24 in order to constrain the extent of pivotal movement of the arm 21. The arm 21 carries a first grinding wheel 25 which is of the cup type and which is driven by an electric motor 26 having a trailing lead (not shown). The motor 26 incorporates stainless steel guards 27 and is fixedly secured to a plate 28 which carries an upstanding pin 29 and which has a screw threaded hole (not shown). The pin 29 passes through a hole in the arm 21 and is secured by a nut 29A. The arm 21 incorporates a slotted hole 30 and this is registrable with the screwthreaded hole in the plate 28 for reception of a clamping screw 31, whereby within limits the orientation of the grinding wheel 25 may be preset to give a desired cutting angle to the knife blade.

Figure 2:
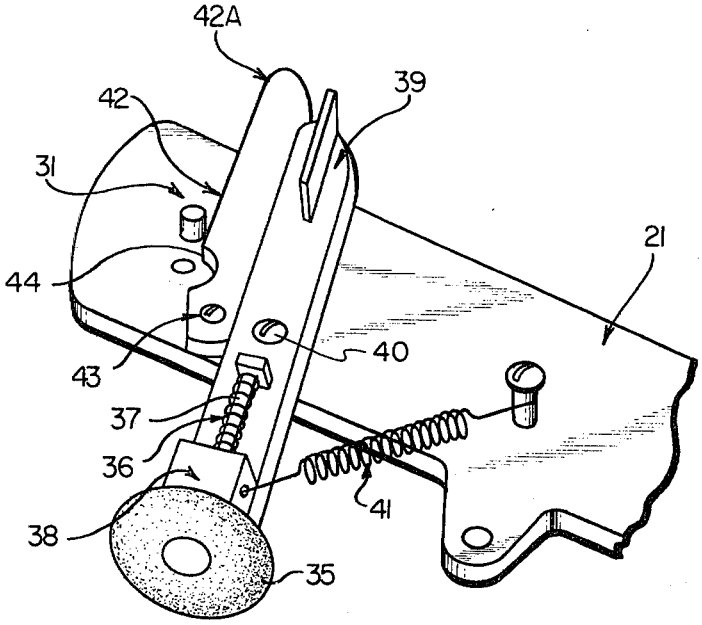
FIG. 2 is a view of another part of the apparatus according to the present invention.

FIG. 2 shows the arm 21 with the other grinding wheel 35 mounted thereon. The wheel 35 is not power driven but is freely rotatable on a spindle 36 and is resiliently urged by a spring 37 against a stop 38 constituted by one end of an elongate carrier 39 pivotally mounted on the arm 21 by means of a set screw 40. The carrier 39 is urged by a spring 41 to an out-of-use position but is pivotally movable into an in-use position and is retainable therein by an elongate spacer 42 having an upturned end 42A for ease of actuation. The spacer 42 is loosely pivoted at 43 and, when in the position shown in FIG. 2, bears against the clamping screw 31, but when the end 42A is lifted, the spacer 42 is free to ride over the screw 31, at least partially, to permit the carrier 39 to move to the out-of-use position due to the action of the spring 41, and to give clearance to the pin 29 the spacer 42 has a cut-out 44.

Figure 3:
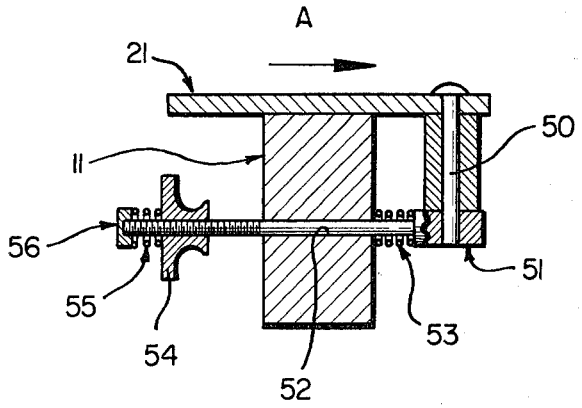
FIG. 3 is a sectional view of part of the apparatus of FIG. 1 taken along A—A'.

The interconnection 24 is shown in section in FIG. 3. There the elongate member 11 supports the arm 21 which carries a depending pivot pin 50 to which is pivotally mounted a rod 51 which passes through an oversize hole 52 in the member 11. Between the pin 50 and the proximal face of the member 11, the rod 51 carries a spring 53 and at its end remote from the pin 50 the rod 51 is screw-threaded carrying a hand-adjustable knurled nut 54, a coil spring 55 and an end stop 56. The sketch of FIG. 3 is schematic and is not to scale, and in normal operation the knurled nut 54 would abut the member 11 or a spacer element surrounding the rod 51 in order that the maximum pivotal movement of the arm 21 in the direction of the arrow A is limited by the nut 54 but movement in the opposite direction is permitted by the resistance of the spring 53. Spring 55 is for backlash compensation.

FIG. 1 illustrates the side of the apparatus which is fitted to the knife blade drive shaft of the slicing machine with the boss 14 entering a circular recess in the knife blade concentrically with the knife blade drive shaft. FIG. 4 shows the opposite side of the apparatus with many parts omitted in the interests of clarity as well as a friction grip drive for driving the elongate member relative the housing. The friction grip drive differs from the gear wheel and rack drive of FIG. 1 in having a peripherally smooth surface wheel engaging a straight smooth surface of the elongate member. Thus, in FIG. 4, there is shown the elongate member 11, the housing 13, and the handle 18. Additionally, there is shown projecting from the housing 13 a sleeve 60 secured to the wheel by a keyway and which acts as a guide for a bolt 61 having a knurled knob 62 whereby the bolt can be projected through the boss 14 (FIG. 1) and be threadedly received by the knife blade drive shaft. At the end of the member 11 remote from the handle 18 a second handle 63 is pivotally secured by means of which the sharpening mechanism which is also mounted at that end of the member 11 can be swept around the perimeter of a stationary knife blade when sharpening thereof is to be effected.

It will be understood that the precise gearing of the cog wheel and the toothed rack 12 will depend upon the specific size and shape of the knife blade to be sharpened but for any given knife blade having a predetermined shape of perimeter, which as a matter of practice will extend through somewhat less than 360 degrees (usually about 300 degrees), the cog wheel and toothed rack 12 can be predetermined.

The extent of movement of the member 11 is limited at one end, the small radius end, by an end stop 65 secured to the housing 13 and abutting a member 66 secured to the member 11. In the embodiment the member 66 forms part of the pivotal mounting 22 for the arm 21. The other limit of travel of the member 11 is not so important and so requires no end stop because it occurs at the maxim radius of the knife blade, and consequently movement of the sharpening mechanism beyond this point will result in no sharpening action taking place.

In the case where the knife blade is freely rotatable about its axis, it may be more expedient to predetermine the angular orientation of the sharpening mechanism 20, and this can be achieved by modifying the described embodiment to provide a slideway guide affixed to the frame of the slicing machine and permitting the elongate member 11 to move longitudinally but not rotationally. In this case, a cranked handle is affixed to the cog wheel, for example, to the sleeve 60 (FIG. 4), in order to rotate the cog wheel and hence the knife blade.

In the second embodiment, the exposed components of the apparatus are also made of stainless steel, in the interests of hygiene, and they comprise, as shown in FIG. 5, an elongate member 111 incorporating a toothed rack 112; a housing 113 through which the member 111 passes and which contains a cog wheel or gear wheel (not shown) in mesh with the rack 112. The cog wheel incorporates a boss 114 which projects through the housing 113 and to which is secured a plate 115, by means of asymmetrically disposed screws 116. The plate 115 carries a spigot or pin 117 which is in a predetermined angular orientation with respect to the cog wheel and rack 112. The housing 113 carries a steel bar 164 to which is connected a handle 118. The member 111 supports an arm mounting 121 for a sharpening mechanism 120 shown in detail in FIGS. 8, 9, 10 and 11, but details of which are omitted from FIGS. 5, 6 and 7 in the interests of clarity.

The sharpening mechanism 120, as shown in FIG. 10, includes a cupped grinding wheel 125 which is driven by a pneumatic motor 126. A rotatable steel wheel or roller 169 is axially mounted on a pin 172 to a carrier 171 which in turn is secured to the elongate member 111 by a steel plate 168 and the arrangement is such that, in use, the edge of the knife blade to be sharpened is positioned against the grinding wheel 125 and the rotatable steel runner wheel 169 which acts as a guide.

The grinding wheel 125 can be moved relative to the roller 169 by means of guides 128 and 129 which are secured to the arm mounting 121. FIG. 11 shows a cross-section of the guide 128 which has a member 170 and which is secured by two screws 179, 180 to the arm mounting 121. The member 170 has two bearings of circular cross-section 175 and 176 which are coaxial and which are a fixed distance apart. The member 170 carries a rod 150 which has a threaded portion 151 at one end, and is positioned such that it is received by the two bearings 175, 176 with the threaded portion distal to the roller 169. A knurled nut 154 is threaded on to the portion 151 of the rod 150 and has a flange 158 which is constrained adjacent the member 170 by an L-shaped steel plate 159. A boss 177 which is positioned between the bearings is secured by screws 178, 179 to the rod 150 and is connected to a steel guard 127 which in turn is connected to a rod 130 which is received by the guide 129. A coil spring 155 which compensates for backlash is mounted on the rod 150 between the bearing 175 and the boss 177.

In normal operation the knurled nut 154 is manually rotated and the threading arrangement causes the rod 150 together with the boss 177 to move relative to the bearings 175 and 176 along a line A—A'. Thus, the rod 130 slides relative to the guide 129 and the grinding wheel 125 is moved relative to the roller 169 in directions parallel to A—A'. Movement in the direction of A is limited by the amount of common thread between the threaded portion 151 and the knurled nut 154 and movement in the direction A' is limited by the end stop 156.

FIGS. 8 and 9 show the arm mounting 121 with the carrier 139 of another grinding means mounted thereon by a bolt 142 and a nut 143. The carrier 139 is urged by a spring 141 to an out-of-use position but is pivotally movable into an in-use position for manual retention therein.

The carrier 139 has a member 140 to which a hardened tip (not shown) can be connected. In normal operation the carrier 139 is manually held such that the hardened tip is positioned on the opposite side of the knife blade to the grinding wheel 125 and thus can remove any burrs produced during the sharpening procedure. The carrier 139 is pivotally fastened to the arm mounting 121 as shown in FIG. 9 in which a bushing 144 is provided with an off-centered aperture for receiving the bolt 142. The bushing 144 fits into an aperture 146 of the carrier 139, and rotation of the bushing 144 results in an ellipsoidal motion of the carrier 139 and thus of the hardened tip (not shown). The ellipsoidal motion of the tip provides tip wear compensation.

FIG. 5 illustrates the side of the sharpener which is fitted to the knife blade drive shaft of the slicing machine with the boss 114 entering a circular recess in the knife blade drive shaft concentrically with the knife blade drive shaft. FIGS. 6 and 7 show a plan view and the opposite side of the sharpener respectively with many parts omitted in the interests of clarity. Thus, in FIGS. 6 and 7 there is shown the elongate member 111, the housing 113, and the handle 118. Additionally, there is shown projecting from the housing 113 a sleeve 160 secured to the cog wheel by a keyway and which acts as a guide for a bolt 161 having a knurled knob 162, whereby the bolt can be projected through the boss 114 (FIG. 1) and be threadedly received by the knife blade drive shaft. At the end of the member 111 remote from the handle 118, a second handle (not shown) may be secured to the same carrier 164 of the handle 118 by means of which the sharpening mechanism 120 can be swept around the perimeter of a stationary knife blade when sharpening thereof is to be effected.

It will be understood that the precise gearing of the cog wheel and the toothed rack 112 will depend upon the specific size and shape of the knife blade to be sharpened, but for any given knife blade having a predetermined shape of perimeter, which as a matter of practice will extend through somewhat less than 360 degrees (usually about 300 degrees), the cog wheel and toothed rack 112 can be predetermined.

The extent of movement of the member 111 is limited at one end, the small radius end, by means of a latching mechanism which includes a latch 165 pivotally mounted on the housing 113 and engaging a pin 166 secured to a plate 121*a* which in turn is fixed to the member 111 through the arm mounting of 121. The latch 165 is spring loaded by a spring 167 and must be manually opened and held open against the spring force to permit initial relative movement between member 111 and housing 113 by means of handle 118. The other limit of travel of the member 111 is not so important and so requires no end stop because it occurs at the maximum radius of the knife blade, and consequently movement of the sharpening mechanism beyond this point will result in no sharpening action taking place.

FIG. 12 shows schematically the knife sharpener mechanism located in an operating position on a knife blade 190 having a cutting edge 191, with many parts omitted in the interests of clarity. The grinding wheel 125 can be adjusted relative to the knife blade 191 via the guide 128, and the roller 169 abuts the adjacent face of the knife blade 190 and maintains the grinding wheel 125 in the required sharpening relationship to the cutting edge 191. The carrier 139 can be manually pivoted to bring the hardened tip 192 into engagement with the opposite side of the cutting edge 191 from the grinding wheel 125 in order to remove any burrs produced during the sharpening procedure.

In the case where the knife blade is freely rotatable about its axis, it may be more expedient to predetermine the angular orientation of the sharpening mechanism 120, and this can be achieved by modifying the described embodiment to provide a slideway guide affixed to the frame of the slicing machine and permitting the elongate member 111 to move longitudinally but not rotationally. In this case, a cranked handle is affixed to the cog wheel, for example, to the sleeve 160 (FIG. 3), in order to rotate the cog wheel and hence the knife blade.

The roller 169 may alternatively be mounted on the housing 113 so that said roller 169 runs on the surface of the knife blade 190.

In the third embodiment, a slicing machine generally designated 202 comprises a surface 203 along which comestible products to be sliced are fed by means (not shown) to an involute knife blade 204, the edge of which moves in shearing cooperation with the end face 203*a* of the surface 203 to slice the product, which slices are received in a receptacle (not shown). The blade 204 is mounted on a drive shaft 205 journalled in a casing or housing 206. The casing includes two sections 206*a* and 206*b* which are hingedly connected together. Section 206*a* is rigidly secured to the surface 203 and section 206*b* functions as a door which is openable to gain access to the end face 205*a* of the drive shaft 205 for the purposes of mounting the sharpener of the invention on the drive shaft 205 and sharpening the knife blade, as will be explained. A toggle latch device 207 is provided to lock or fasten sections 206*a* and 206*b* together during normal use of the machine 202. Apertures or openings 208*a* and 208*b* are provided in the casing sections 206*a* and 206*b*, respectively, to permit the product to be fed past the knife blade 204. The drive shaft 205 is rotatably driven by means of a drive motor (not shown) mounted on a recessed portion of the casing end wall containing aperture 208*a*.

The casing 208, particularly segment 208*a*, is made of a rigid material such as steel or aluminum or a metal alloy and is of such a strength as to withstand the significant forces imposed on the casing by the rotational motion of the knife blade 204. Since the knife blade 204 is non-circular, an appropriate balancing means such as a counterweight 201 (see FIG. 22) is secured thereto by a lock nut 200 so that no unbalanced forces result during rotation of the blade 204.

In order to sharpen the cutting edge of the blade 204, the casing 206 is opened by releasing the toggle latch 207 and moving casing section 206*b* on its hinges to the position indicated in FIG. 13. This exposes the end face 205*a* of the shaft 205 and, as is shown in greater detail in FIG. 14, this end face includes a coaxially extending cylindrical recess 209 which leads into an internally threaded coaxially extending socket 210 for the purpose of receiving an externally threaded shaft forming part of the sharpener. The end face 205*a* includes a radially extending groove or slot 211 which is in a predetermined angular position with respect to the blade 204 and receives a spigot or lug 219 forming part of the sharpener to provide the correct angular orientation of the sharpener when it is mounted on the end face 205*a* of the drive shaft 205.

The sharpener, which is generally designated 212, is shown in elevational view in FIG. 15 and in top plan view in FIG. 19, and comprises a shaft 214 which is externally threaded at 215 and is of a suitable dimension to fit the socket 210. At the end of the shaft 214 remote from the threading 215, a hand wheel 216 is secured to the shaft in such a manner that rotation of the hand wheel 216 rotates shaft 214. A cog wheel or pinion gear 217 is rotatably mounted on a unthreaded portion of shaft 214 and carries a coaxial spigot or boss 218 and a non-coaxial or eccentrically positioned spigot or lug 219. The lug 219 is dimensioned to fit within the groove 211, whereas boss 218 is dimensioned to fit within the recess 209. The lugs 218 and 219 both project from a circular boss or bearing which is an integral part of the pinion gear 217 and on which there is rotatably mounted a plate member 220 forming part of a support means for other components of the sharpener. The plate member 220 is connected to a further plate member 221 by means of bolts 222 and spacer elements (not shown). Plate member 221 is also rotatably mounted on a circular boss or bearing forming part of the pinion gear 217. The portion of the gear 217 which is housed in the space between plate members 220 and 221 has gear teeth around its periphery which are in mating and driving engagement with gear teeth 223 formed on an elongate member 224 which extends laterally with respect to the axis of shaft 214 through the space between plate members 220 and 221. The elongate member 224 is in the form of a rack gear. At one end of the elongate member 224 there is mounted a sharpening mechanism 225 which includes a cupshaped sharpening stone 226 mounted on a rotatable drive shaft 227 which is driven by a pneumatic motor 228. As a safety measure a guard 226*a* surrounds stone 226 as shown in FIG. 19, but this is omitted from FIG. 15 in the interests of clarity. The guard 226*a* also acts to collect the majority of the grindings produced during the sharpening process.

The body of the motor 228 is provided with external screw threads 229 and is threadedly received by a mounting block 230 which is secured by means of screws 231 to the flange 232 of a bracket having a flange 233 of which is fastened by screws 234 to the elongate member 224. By virtue of the threads 229, the location of the motor 228 with respect to the block 230 is adjustable and, to lock the motor 228 in the desired position, a lock nut 235 is threaded onto threads 229 to abut the block 230. A peg or pin 236 made of plastic material, such a polytetrafluorethylene, is mounted in block 230 tangentially to intercept the interface between the threads 229 and the mating threads formed in block 230. The end face of the block 230 which abuts the undersurface of plate 232 is angled by about thirty degress so that the axis of the motor 228 is inclined by a similar amount to the undersurface of the plate 232, whereby only part of the stone 226 engages the knife edge during the sharpening operation.

The support means of the sharpener, in addition to the plate member 220 and 221, includes an L-shaped elongated arm 238 which is secured between plate members 220 and 221 by three of the bolts 222 so that components 220, 221 and 238 are rigidly interconnected. The arm 238 extends in a direction parallel to the longitudinal axis of the elongate member 224 and acts as a guide for a guide block 239 made of a suitable plastic, such as nylatron. The block 239 is slidably mounted on the arm 238 and is secured by means of screws 240 to the flange 232 of the bracket carrying the sharpening mechanism 225. The block 239, which is shown in cross section in FIG. 20, has two slots **239*a* and 239*b*, respectively, positioned to receive and to be a close sliding fit with the legs 238*a* and 238*b* of the arm 238, which eliminates undesired movement of the sharpening mechanism 225 in two directions but permits freedom of movement of the mechanism 225 in the direction of the longitudinal axis of the elongate member 224**.

At its end 241 remote from the plate members 220 and 221, the arm 238 carries a fixed handle 242 and a fixed mounting 243 on which a guide roller 244 is rotatably mounted. It will therefore be appreciated that the handle 242 and guide roller 244 are each at a fixed radial distance from the axis of the shaft 214. This distance is selected to be the same as the radial dimension of the peripheral wall of the casing 206 of the slicing machine 202 so that when the sharpener is fitted to the knife blade drive shaft 205 in the manner described above, the guide roller 244 is positioned to run on the circular surface 245 of casing section **206*a* which lies at the interface between casing sections 206*a* and 206*b* as is illustrated in FIG. 22**.

The elongated arm 238 provides a first constraint on the movement of the elongate member 224 by virtue of the interconnecting guide block 239, and a second constraint is imposed on the member 224 by means of a roller 246 mounted on an eccentric between the plate members 220 and 221 remote from the sharpening mechanism 225. The eccentric is adjustable by screw 247 to take up any backlash which may exist between the teeth 223 of the member 224 and the teeth on the pinion gear 217. The arm 238 also acts as a support for a fitting 248 which delivers the pressurized air supply to the pneumatic motor 228.

In order to use the sharpener to sharpen the cutting edge of the knife blade 204, the casing 206 is opened and the knife blade 204 is secured in a fixed position by means of a mechanical clamp 249 located within the casing (see FIG. 13). The clamp 249, when actuated to hold the knife blade 204, also prevents the casing 206 from being closed. The sharpener is then fitted to the end face **205*a* of the drive shaft 205 by engaging boss 218 within recess 209, and lug 219 with groove 211 and shaft 214 with socket 210. The dimensions and arrangement of these components are such that guide roller 244 engages surface 245, while at the same time the cup-shaped sharpening stone 226 engages the cutting edge of the knife blade. The pressure of the sharpening stone 226 on the knife blade is adjustable by means of lock nut 235 and is subject to fine adjustment by the operator. When the correct pressure has been achieved, the pneumatic motor 228 is energized to rotate the sharpening stone 226 and the sharpener is moved manually by means of handle 242 in a series of to-and-fro arcuate movements, during which time the guide roller 244 continuously runs on surface 245 and elongate member 224 moves longitudinally and pivotally so that the sharpening mechanism 225 exactly follows the involute contour of the knife blade cutting edge. The pivotal movement of the elongate member 224 is accompanied by pivotal movement of the plate members 220 and 221 on the pinion gear with respect to the axis of shaft 214, it being appreciated that the pinion gear 217 is connected to the blade shaft 205 and held stationary against rotational movement by engagement of the lug 219 in the slot 211** of the drive shaft.

When the sharpening procedure has been completed, the sharpener is removed from the slicing machine by manual manipulation of the hand wheel 216. The mechanical clamp 249 is released, thereby freeing the knife blade 204 and the casing 206 is closed and latched in the closed position by the toggle latch 207.

It has been found that when the above-described sharpening procedure has been completed, depending upon the coarseness of the stone 226, the texture of the knife blade 204, the pressure exerted on the blade 204 by the stone 226 and the rotational speed of the stone 226, which is usually on the order of 1500 rpm, the cutting edge of the blade 204 is left with adherent metal burrs. To remove these burrs, it is preferable to attach to the sharpener a deburring device and a convenient example of such a device is shown in FIGS. 17 and 18 and generally designated 260. The device 260 is attached to the undersurface of bracket flange 232 in the space between flange 232 and sharpening mechanism 225, and it comprises a body 261 pivotally mounted at 262 on flange 232. The body 261 forms a support within which is located a shaft 263, one end of which carries a deburring tool 264. The other end of the shaft 263 has a stop or collar 265, and a spring 266 located between the stop 265 and the body 261 to provide a resilient loading for the tool 264. The body 261 also carries a boss 267 which is arranged to project through the bracket flange 232 and a manually operable handle 268 is secured to this boss and extends between the upper surface of bracket flange 232 and the undersurface of arm 238, whereby the device 260 can be pivoted to its in-use position for removal of burrs from the knife edge. The in-use position is determined by an abutment 269 secured to the undersurface of bracket flange 232 against which the body 261 is urged by the operator. In this position the tool 264, which comprises a pad of highly hardened material, scrapes, rubs or otherwise removes burrs by engaging the rear face **204*a*, FIG. 22, of the knife blade 204. The pivotal mounting at 262 provides a friction grip of limited strength between the bracket flange 238 and body 261, whereby the position of the device 260 is retained after having been set by the handle 268. If so desired, the body 261 may be spring urged to an out-of-use position. In FIG. 17, numeral 231***a* designates the holes in bracket flange 232 which receive the screws 231 for securing the block 230 in position.

It will be understood that the sharpener described herein is preferably fabricated from non-corrosive materials.

It will be understood that modifications and variations may be effected without departing from the scope of the novel concepts of the present invention, but it is understood that this application is to be limited only by the scope of the appended claims.

The invention is hereby claimed as follows:

1. Apparatus for sharpening a knife blade of a slicing machine comprising a first member securable coaxially to the knife blade drive shaft in a predetermined orientation, said first member having a peripheral drive surface, an elongate member in driving connection with the drive surface of the first member, a knife blade sharpening mechanism mounted at one end of said elongate member, means for effecting relative pivotal and longitudinal movement of the elongate member with respect to the drive surface of the first member, means for positioning said first member relative to the elongate member so that said relative pivotal and longitudinal movement causes said sharpening mechanism to follow a predetermined non-circular path.

2. Apparatus as claimed in claim 1, wherein said driving connection comprises matched (gear) teeth formed respectively on the first member and on the elongate member.

3. Apparatus as claimed in claim 1, wherein said driving connection comprises a friction-grip between said first member and said elongate member.

4. Apparatus as claimed in claim 1, wherein said means for effecting relative pivotal and longitudinal movement comprises a handle secured to a housing surrounding the driving connection whereby, in use, the elongate member is pivotally movable manually, and longitudinally movable by said driving connection, and the first member is held stationary in relation to the knife shaft.

5. Apparatus as claimed in claim 1, wherein said means effecting relative pivotal and longitudinal movement comprises slideway-defining elements receiving said elongate member and a handle connected to said elements whereby, in use, when the elongate member is rotated manually the elongate member is constrained against rotational movement relative said elements but is free to move longitudinally.

6. Apparatus as claimed in claim 1, wherein said sharpening mechanism comprises first and second means disposed for engagement with opposite sides of the knife blade.

7. Apparatus as claimed in claim 6, wherein said first means is a grinding wheel connected to a drive means and the second means is a non-driven tip made of a highly hardened material.

8. Apparatus as claimed in claim 6, wherein the second means is a grinding wheel which is freely rotatable on a spindle.

9. Apparatus as claimed in claim 8, wherein the grinding wheel is mounted on a carrier which is movable between an in-use position and an out-of-use position and which, in use, scrapes or otherwise removes from the rear of the blade burrs which are produced during the sharpening procedure.

10. Apparatus as claimed in claim 9, wherein said grinding wheel is spring biased axially of its mounting on said carrier.

11. Apparatus as claimed in claim 7, wherein said drive means is adjustably secured on a carrier, whereby the grinding angle may be adjusted.

12. Apparatus as claimed in claim 11, wherein said carrier includes an interconnection to constrain the extent of pivotal movement of said carrier with respect to the elongate member, said interconnection including a resilient element whereby said carrier is angled pivotally in a predetermined direction.

13. Apparatus as claimed in claim 12, wherein said resilient element is a spring.

14. Apparatus as claimed in claim 1, wherein said knife blade drive shaft forms part of a slicing machine having a knife blade of involute or non-circular shape, and said sharpening means includes a grinding wheel.

15. Apparatus as claimed in claim 14, wherein the grinding wheel follows a path parallel to the contour of the cutting edge of the knife and wherein, the elongate member is supported by means of a roller running on a machined bevel on said knife so that the actual grinding section of this grinding wheel follows the plane of said cutting edge.

16. Apparatus as claimed in claim 14, wherein the grinding wheel follows a path parallel to the contour of the cutting edge of the knife and has a handle secured to said elongate member which is supported by means of a roller running on a machined surface of the machine casing carrying the knife shaft to which said knife is connected to that the actual grinding section of the grinding wheel follows the plane of the cutting edge.

17. Apparatus as claimed in claim 1, wherein the first member and the knife blade incorporate interengageable elements, whereby the predetermined orientation of the first member is ensured when the elements are interengaged.

18. Apparatus as claimed in claim 17, wherein said interengageable elements are in the form of a spigot and a socket.

19. Apparatus as claimed in claim 7, wherein said drive means is an electric motor.

20. Apparatus as claimed in claim 7, wherein said drive means is a pneumatic motor.

21. Apparatus for sharpening an involute knife blade carried on and rotatable with a drive shaft of a slicing machine which comprises, an elongated arm extending substantially parallel to the blade and perpendicular to the drive shaft thereof, a sharpening member mounted on the arm and engageable with the knife edge of the blade, a housing slidably receiving said arm such that the arm is longitudinally movable relative to the housing and generally perpendicular to the axis of the drive shaft, said housing having a support shaft connectable to the drive shaft of the machine and defining a pivot between the arm and blade, and means in the housing coupled to the drive shaft to prevent relative movement therebetween and engaging the arm to drive the arm during relative rotational movement between the blade and arm to maintain the sharpening member in sharpening engagement with the knife edge at all times.

22. Apparatus as defined by claim 21, wherein said means includes a pinion gear portion and said arm includes a rack gear portion in meshing engagement with said pinion gear portion.

23. Apparatus as defined by claim 21, which further includes means constraining said arm during longitudinal movement thereof.

24. Apparatus as defined by claim 21, which further includes means constraining said arm during rotational movement thereof.

25. Apparatus as defined by claim 21, which further includes means constraining said arm during longitudinal and rotational movement thereof.

26. In a slicing machine having a drive shaft and an involute knife blade carried on and rotatable with the drive shaft, a sharpener for said knife blade selectively mountable on the drive shaft for sharpening the blade, said sharpener comprising a support shaft coaxially attachable to said drive shaft, a base rotatably carried on said support shaft, an arm slidably received by said base and having a sharpening tool at one end for engaging the knife blade, and means locked to said drive shaft and engaging said arm to drive the arm during rotation of said arm on said support shaft to always maintain the sharpening tool in sharpening engagement with the knife blade.

27. In an apparatus for sharpening an involute slicing machine knife blade which includes a first member securable coaxially to the knife blade drive shaft in a predetermined angular orientation, said first member having a peripheral drive surface, an elongate member in driving connection with the drive surface of the first member, a knife blade sharpening mechanism mounted at one end of said elongate member, means for effecting relative pivotal and longitudinal movement of the elongate member with respect to the drive surface of the first member, wherein the first member and the elongate member are dimensioned and arranged so that, in use, said relative pivotal and longitudinal movement causes said sharpening mechanism to follow a predetermined non-circular path, the improvement comprising a support means confining the first member and the elongate member to maintain said driving connection, a rigid arm extending laterally from said support means in a direction parallel to the longitudinal axis of the elongate member and a guide member secured to the elongate member adjacent the sharpening mechanism and slidably mounted on said rigid arm, and a guide roller mounted on the rigid arm at a fixed location beyond the sharpening mechanism, whereby the guide roller may run along a fixed circular guide path radially beyond the cutting edge of the knife blade.

28. Apparatus as claimed in claim 27, wherein the rigid arm is of L-section and the guide member has two slots respectively positioned to receive the legs of the rigid arm in such a manner as to eliminate movement of the sharpening mechanism in two directions while permitting freedom of movement thereof in the direction of the longitudinal axis of the elongate member.

29. Apparatus as claimed in claim 27, wherein the sharpening mechanism includes a support secured to the elongate member and incorporating a threaded aperture, and a sharpening stone drive motor with a cylindrical housing which is externally threaded and mounted in the threaded aperture of the support.

30. Apparatus as claimed in claim 29, wherein said support includes a plastic pin tangentially intercepting the interface between the threads of the support and the threads of the drive motor housing.

31. Apparatus as claimed in claim 27, wherein a handle is mounted on said arm adjacent said guide roller for effecting pivotal movement of the arm with respect to said first member.

32. Apparatus as claimed in claim 27, including a deburring device adjacent the sharpening mechanism.

* * * * *